US005647146A

United States Patent [19]

Gabrielli et al.

[11] Patent Number: 5,647,146

[45] Date of Patent: Jul. 15, 1997

[54] TONGUE FOR INTERNAL SHOES OF SKI BOOTS

[75] Inventors: Andrea Gabrielli, Predazzo; Antonello Marega, Volpago, both of Italy

[73] Assignee: TECNICA Spa, Treviso, Italy

[21] Appl. No.: 504,576

[22] Filed: Jul. 20, 1995

[30] Foreign Application Priority Data

Aug. 4, 1994 [IT] Italy ..... TV940048 U

[51] Int. Cl.[6] ..... A43B 23/26; A43B 3/10; A43B 5/04

[52] U.S. Cl. ..... 36/54; 36/10; 36/117.9

[58] Field of Search ..... 36/54, 55, 10, 36/117.6, 117.9

[56] References Cited

U.S. PATENT DOCUMENTS

| | | | |
|---|---|---|---|
| 4,406,073 | 9/1983 | Spademan | 36/54 |
| 4,534,122 | 8/1985 | MacPhail | 36/54 |
| 4,583,306 | 4/1986 | Paris | 36/117.9 |
| 4,920,666 | 5/1990 | Marega | 36/54 |
| 5,174,050 | 12/1992 | Gabrielli | 36/55 |
| 5,265,353 | 11/1993 | Marega | 36/54 |

FOREIGN PATENT DOCUMENTS

| | | | |
|---|---|---|---|
| 569829 | 11/1993 | European Pat. Off. | 36/54 |
| 0647414 | 4/1995 | European Pat. Off. . | |
| 0657114 | 6/1995 | European Pat. Off. . | |
| 1810291 | 6/1970 | Germany . | |
| 9213810 | 12/1992 | Germany . | |
| 8900015 | 1/1989 | WIPO . | |

*Primary Examiner*—M. D. Patterson

*Attorney, Agent, or Firm*—Griffin, Butler, Whisenhunt & Kurtossy

[57] ABSTRACT

A padding (14), which is covered internally with a lining (18) and externally with a rigid layer (16), is provided in a tongue for the internal shoes of ski boots. The padding (14) is divided into a lower portion (14*a*) which is integral with the rigid layer (16) and an upper portion (14*b*) which is integral with a sliding insert (20) interposed between the upper portion itself and the rigid external layer (16). The position of the sliding insert (20) and thus of the upper padding (14*b*) varies between a lower limit position in which the sliding insert (20) is completely lowered and un upper limit position in which the sliding insert (16) is completely raised.

10 Claims, 4 Drawing Sheets

TONGUE FOR INTERNAL SHOES OF SKI BOOTS

The present invention relates to a tongue for the internal shoes of ski boots.

BACKGROUND OF THE INVENTION

The internal shoes of ski boots generally have a longitudinal front opening defining two limbs, which thus facilitates the introduction of the foot into the shoe. The internal shoes are also provided with a tongue for closing the longitudinal opening. In particular, reference may be made to the internal shoe depicted in U.S. Pat. No. 5,553,402 issued on Sep. 10, 1996 and commonly assigned with this application, in which the tongue is connected to the shoe by means having slots and pins which enable it to move longitudinally, and thus to float. The use of floating tongues has contributed to the achievement of various results; however, it has been observed that skiers, who are ever more demanding, require other possibilities and adjustments from a ski boot.

Skiers first of all wish to be able to adjust the rigidity or flexibility of the boot in the longitudinal plane and also to be able to vary the extend to which the shoe surrounds their leg. Every skier requires a particular ski boot adjustment which depends not only on subjective factors, for example, some skiers prefer to ski with a ski boot which is fairly rigid and surrounds the leg in a satisfactory manner, but also on objective factors, for example the type of descent (free descent, slalom, etc.) and the height and weight of the skier. In addition, in the case of special skiing activities, such as snow-boarding, because the position of the boots is asymmetrical, each boot requires a different adjustment. The object of the present invention is thus to produce a tongue for ski boots which enables the above-mentioned nowaday requirements and possibilities demanded by skiers to be satisfied and provided the same simply and economically. A further object of the invention is to reduce the pressure exerted by the tongue on the front part of the leg when the boot is locked by the closing levers, thus increasing the skier's comfort.

SUMMARY OF THE INVENTION

These objects are achieved by means of a tongue of the type comprising an intermediate layer of padding, a covering internal layer or lining and a rigid external layer, characterized in that the padding is divided into a lower portion which is integral with the rigid external layer and an upper portion which is integral with an insert which slides longitudinally and is interposed between the padding portion itself and the rigid external layer, the said lining being stretchable resiliently, thus defining, for the sliding insert and the upper padding portion which is integral therewith, a lower limit position in which the sliding insert is completely lowered and the two padding portions are adjacent to each other and an upper limit position in which the sliding insert is completely raised and the two padding portions are at a distance from each other and the lining is stretched resiliently.

Thus, if the skier wishes to have a shoe which surrounds his leg satisfactorily, he raises the sliding insert, and if, on the other hand, he requires a shoe which surrounds his leg to a lesser extent, he lowers the sliding insert completely.

Furthermore, by raising the sliding insert, the tightening force exerted by the boot locking means is distributed over a larger surface area, thus reducing the pressure on the leg and consequently increasing the skier's comfort.

According to a preferred embodiment of the invention, the sliding insert may assume intermediate positions, thus permitting a more sensitive adjustment.

In a particular embodiment, the facing edges of the two padding portions have complementary "comb profiles", so that, in the lower limit position, that is to say, with the sliding insert and thus the upper padding portion completely lowered, the two "comb profiles" mate and, in the upper limit position, that is to say, with the sliding insert and thus the padding completely raised, the ends of the "comb profiles" interengage in alternation.

Thus, if the sliding insert is completely raised, there is no sudden interruption in the padding and thus the wearer's comfort remains unchanged.

In another application of the invention, a reinforcing member is applied to the rigid external layer. It is thus possible to vary the flexibility of the boot in the longitudinal plane simply by altering the thickness of the reinforcing member or the material of which it is made.

BRIEF DESCRIPTION OF THE DRAWINGS

These and other features and advantages of the invention will be better appreciated from the following detailed description of an embodiment thereof which is given by way of non-limiting example with reference to the following drawings in which.

DESCRIPTION OF PREFERRED EMBODIMENTS

Figure 1:
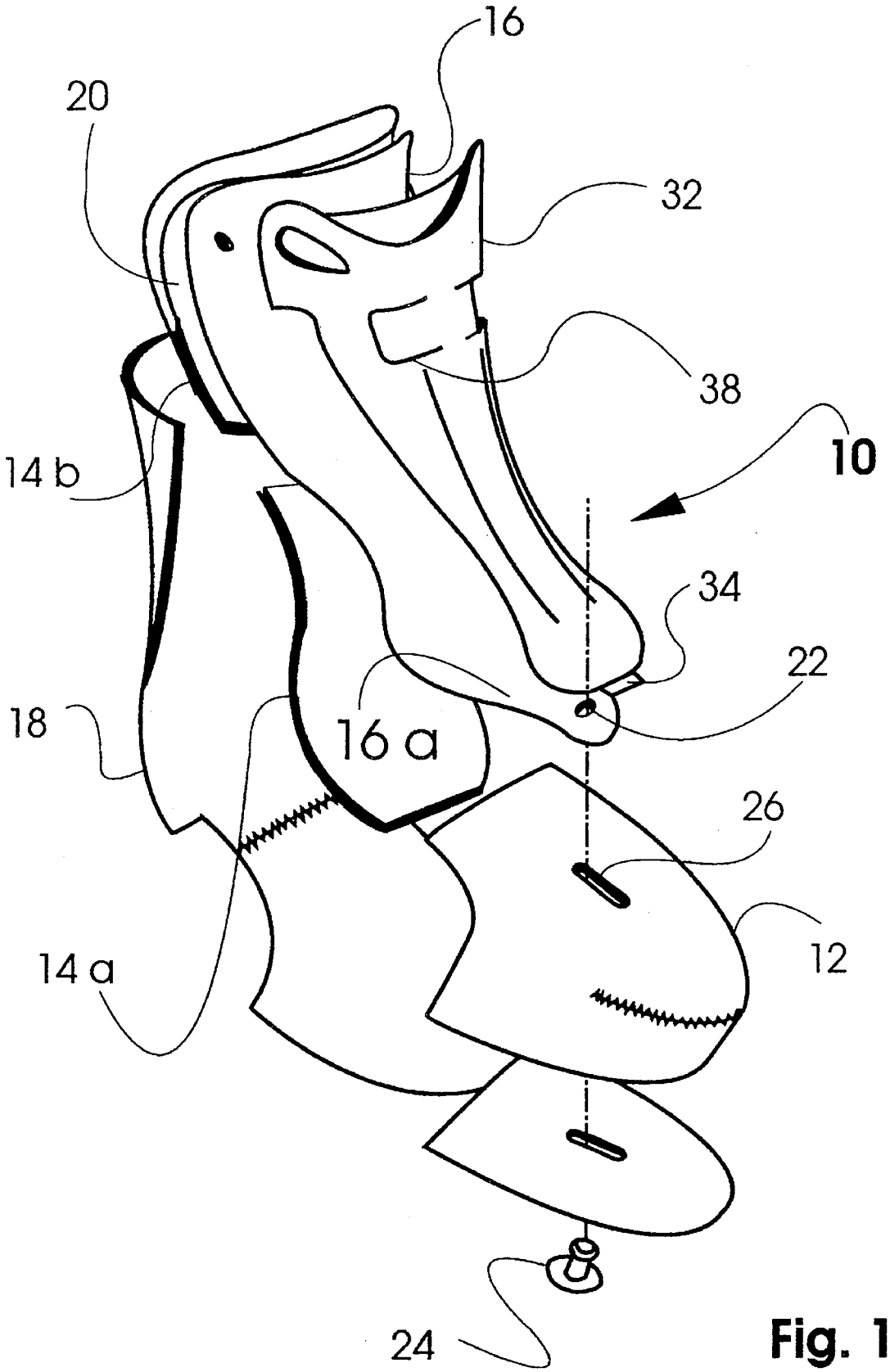
FIG. 1 is an exploded perspective view of an assembly comprising the tongue and toe of a shoe according to the invention.
Figure 2:
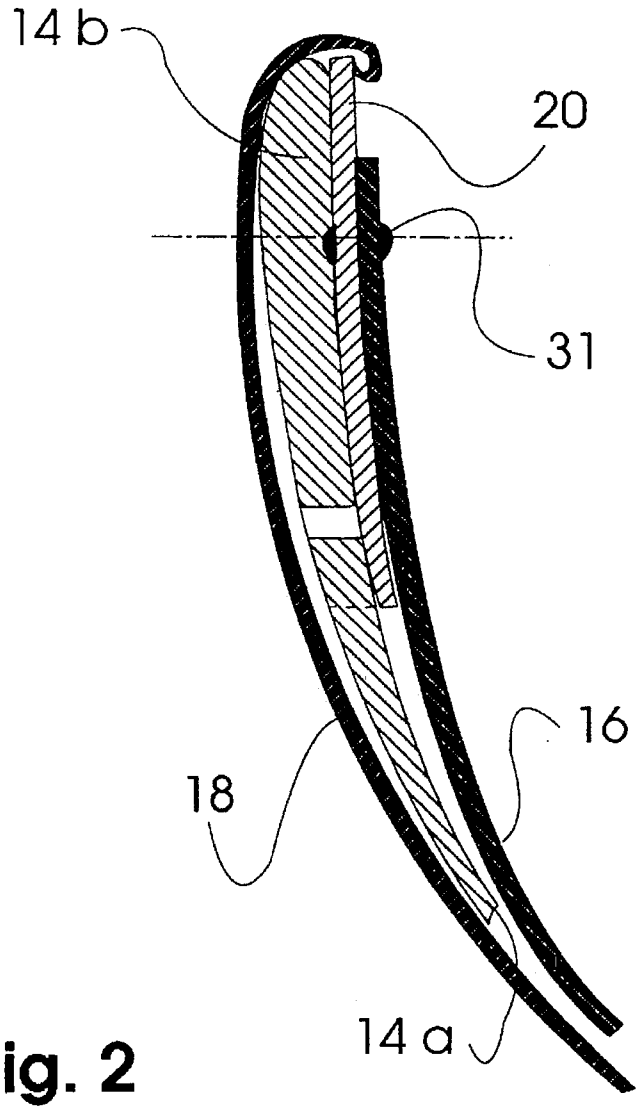
FIG. 2 is a partial longitudinal section through the tongue of FIG. 1.

FIGS. 1 and 2 show a tongue 10 connected to a toe 12 of an internal shoe for ski boots.

The tongue 10 comprises a padded intermediate layer or padding divided into a lower porition 14*a* and an upper portion 14*b*, a rigid external layer 16 and an internal covering layer or lining 18; the lining 18 also covers the internal portion of the toe 12. The lower padding portion 14*a* is rigidly secured to the rigid external layer 16, for example, by means of an adhesive, whilst the upper padding portion 14*b* is secured to an insert 20 interposed between the upper portion 14*b* and the rigid external layer 16.

Figure 3:
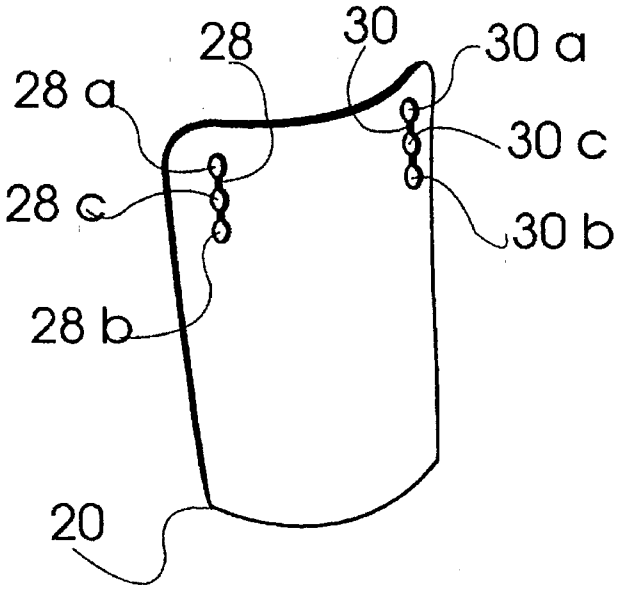
FIG. 3 is a front view of the sliding insert used in the said tongue.

It can be seen from FIGS. 2 and 3 that the upper portion of the insert 20 is of a shape corresponding to that of the upper padding portion 14*b*. The upper padding portion 14*b* is secured to the sliding insert 20, for example, by means of an adhesive.

Both the lower portion 14*a* and the upper padding portion 14*b* are covered at the underside by the lining 18, the edge of which is stitched to the edge of the upper portion of the sliding insert 20 and to the edge of the lower portion of the rigid external layer 16.

The rigid external layer 16 has, at its lower end 16*a*, a hole 22 in which a pin is secured to slide in a longitudinal slot 26 in the toe 12 of the shoe.

The tongue 10 is therefore able to slide longitudinally with respect to the shoe. As already stated, this connection also forms part of the subject-matter of the above-mentioned U.S. patent.

FIGS. 2 and 3 show that the sliding insert 20 has, in its upper portion, two longitudinal slots 28, 30 in each of which slides a respective pin 31 which is secured in the rigid external layer 16. The longitudinal slots 28, 30 are provided with two widened opposing ends 28*a*, 28*b* and 30*a*, 30*b* and also an intermediate widened portion 28*c*, 30*c* constituting seats for accomodating the pins 31.

Figure 6:
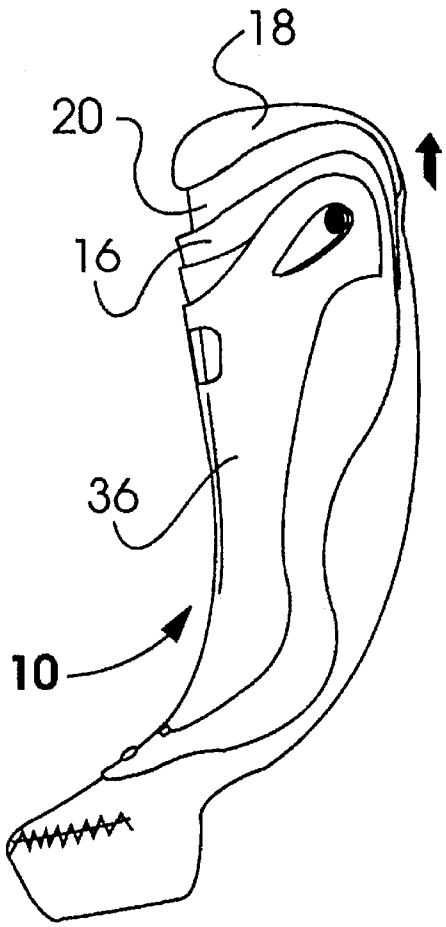
FIGS. 4, 5 and 6 are side views of the tongue of FIG. 1 in which the upper padding portion is shown in three different positions.
Figure 5:
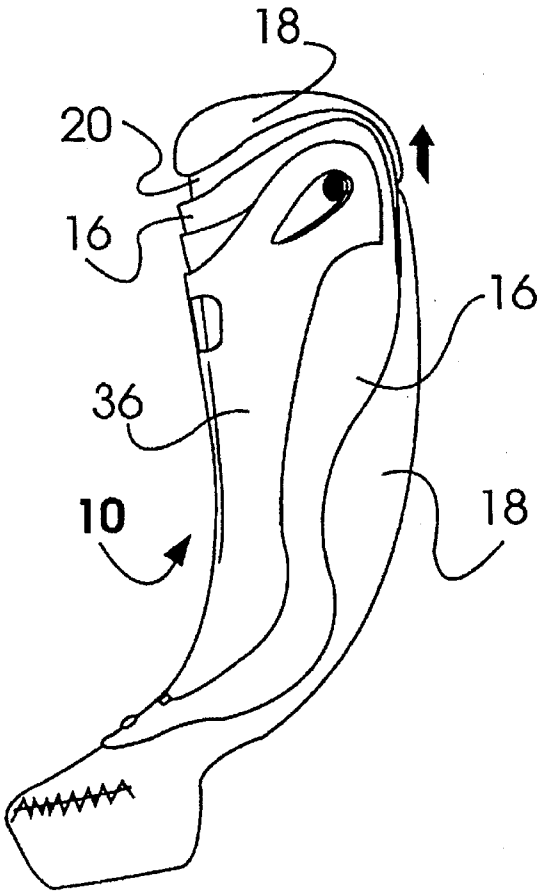
Figure 4:
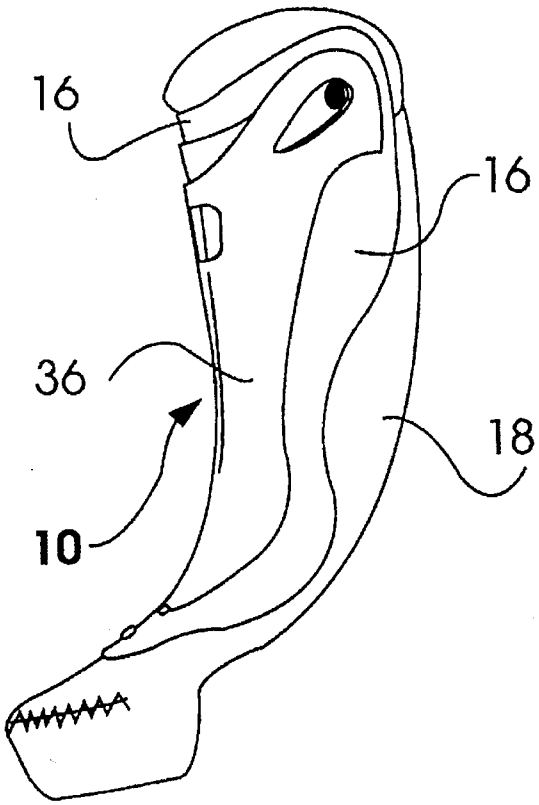

Consequently, the insert 20 and thus the upper padding portion 14*b* can slide longitudinally between two limit positions: a lower limit position (see FIG. 4) in which the insert 20 is completely lowered and thus the pins 31 abut the ends 28*a*, 30*a* of the respective slots 28, 30 and an upper limit position (see FIG. 6) in which the insert 20 is completely raised and the pins 31 abut the ends 28*b*, 30*b* (see FIG. 2). The insert 20 can also assume an intermediate position shown in FIG. 5 in which the pins 31 are accomodated in the widened portion 28*c*, 30*c* of the respective slots 28, 30.

If the skier wishes to change the position of the insert 20 and therefore of the upper padding portion 14*b*, he simply grips the upper end of the insert 20 which slides outwards or inwards with respect to the tongue 10, depending on the direction in which the force is applied.

Of course, in order to enable the insert 20 to move, the lining is produced from a resilient material so that it can stretch when the insert 20 is moved out to the desired extent as a result of the sliding of the tongue 10.

Figure 8:
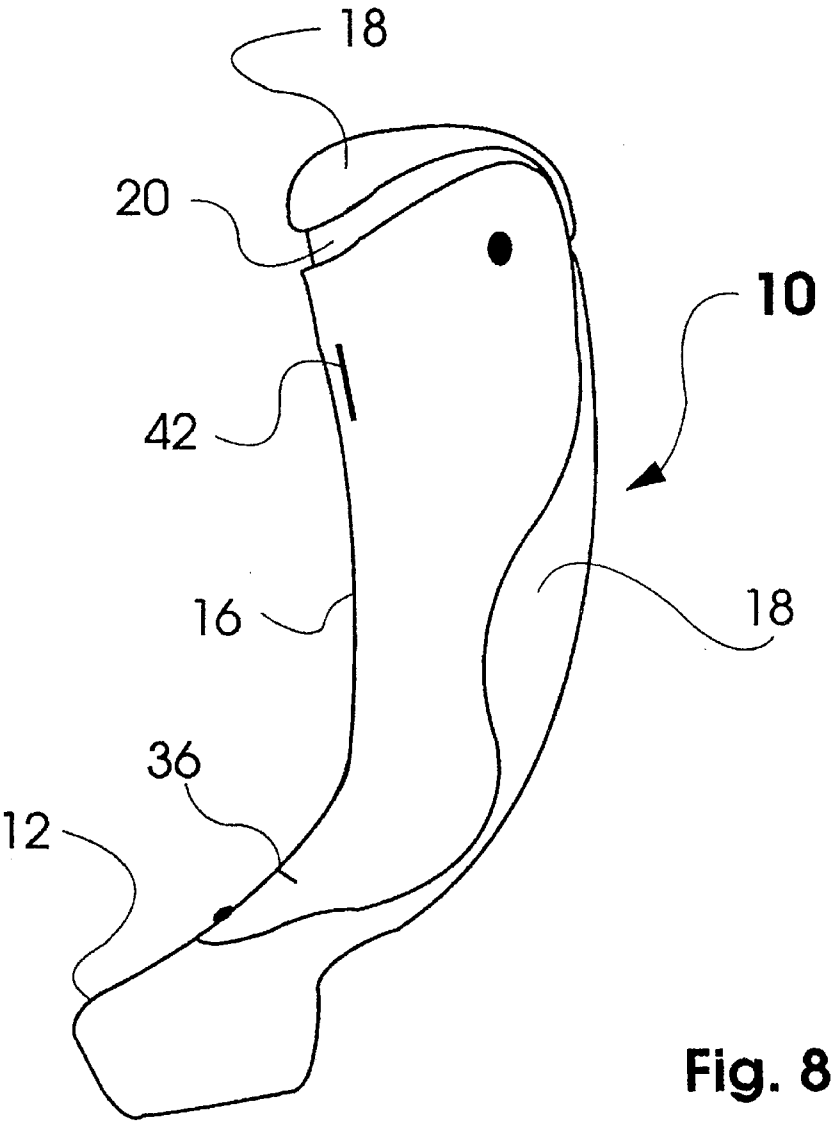
FIGS. 7 and 8 are, respectively, side views of the reinforcing member and the tongue without the said member.
Figure 7:
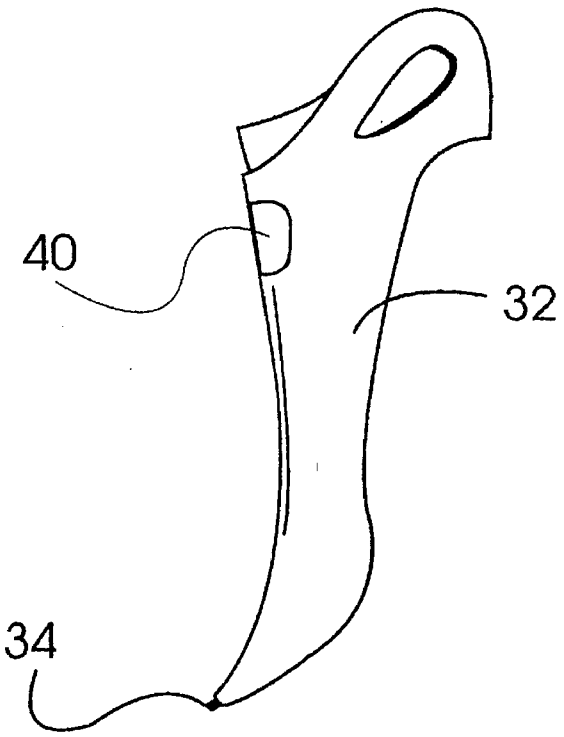

FIGS. 1 and 7 show a reinforcing member 32 which has a shape similar to that of the rigid external layer 16 but with slightly smaller dimensions and which can be applied to the external surface of the said layer. The reinforcing member 32 is provided at its lower end with a tab 34 which can be fitted into a slot 36 in the lower portion of the rigid external layer 16 (see FIG. 8). The upper portion of the reinforcing member 32 is provided with two fins 38, 40 which can be inserted into corresponding slots 42 in the upper portion of the rigid external layer 16 (see FIG. 8).

By suitably changing the thickness or the type of material of the reinforcing member 32, the flexibility of the tongue and therefore of the boot can be changed in the longitudinal plane. In the extreme state of there being no reinforcing member 32, the rigidily value will of course be the minimum the possible. At last, it is clear that modifications or variants of equivalent design or function fall within the coverage of the present invention. For example, in a situation where the insert is completely raised, that is to say, extracted from the tongue, in order to prevent the skier noticing the lack of padding in the separating area between the upper padding portion and the lower portion, it is possible to provide the facing edges of the two portions with a complementary "comb portion". In the position in which the insert is completely raised, a reciprocal engagement, however minimal, should preferably take place between the two profiles so that the padding is present along the entire longitudinal profile of the tongue.

We claim:

1. In a tongue for internal shoes of ski boots comprising an intermediate padding (14), a lining (18) and a rigid external layer (16), the improvement wherein the padding (14) is divided into a lower padding portion (14*a*) which is integral with the rigid external layer (16) and an upper padding portion (14*b*) which is integral with a sliding insert (20) interposed between the upper padding portion and the rigid external layer (16), said lining (18) being stretchable, and means for defining for the insert (20) and the upper padding portion (14*b*), a lower limit position, in which the insert (20) is completely lowered and both said padding portions (14*a*, 14*b*) are adjacent each other and an upper limit position in which the insert (20) is completely raised and the said padding portions (14*a*, 14*b*) are at a distance from each other and the lining (18) is stretched.

2. Tongue according to claim 1, wherein at least one of the sliding insert (20) and rigid external layer (16) is provided with at least one longitudinal slot (28, 30) in which slides an at least one pin (31) secured to the other of the insert (20) or rigid external layer.

3. Tongue according to claim 2, wherein said at least one slot (28, 30) is arranged on the sliding insert (20) and said at least one pin (31) is secured to the rigid external layer (16).

4. Tongue according to claim 2, wherein there are two slots (28, 30) and two respective pins (31).

5. Tongue according to claim 2, wherein each slot (28, 30) has, at both of its ends (28*a*, 18*b* and 30*a*, 30*b*), a widened portion which can determine said limit positions of the sliding insert (20).

6. Tongue according to claim 5, wherein each slot (28, 30) has as least one widened portion (28*c*, 30*c*), in an intermediate position, each of which is able to define for the sliding insert (20) a position intermediate between said limit positions.

7. Tongue according to claim 1, wherein the lining (18) is produced from resilient material.

8. Tongue according to claim 1, wherein a reinforcing member (32) is applied to the rigid external layer (16).

9. Tongue according to claim 8, wherein the reinforcing member (32) is elongate and lower and upper ends thereof engage with upper and lower ends, respectively, of the rigid external layer (16).

10. Tongue according to claim 9, wherein the reinforcing member (32) has, at a lower end, a tab (34) which is engageable in a slot (36) in a lower portion of the rigid external layer (16) and, at an upper portion, has two fins (38, 40) which are engageable in corresponding slots (42) in the rigid external layer (16).

* * * * *